US007930888B2

(12) United States Patent
Parker

(10) Patent No.: US 7,930,888 B2
(45) Date of Patent: Apr. 26, 2011

(54) VARIABLE GEOMETRY TURBINE

(75) Inventor: John Frederick Parker, Huddersfield (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 0 days.

(21) Appl. No.: 12/322,578

(22) Filed: Feb. 4, 2009

(65) Prior Publication Data

US 2009/0142186 A1 Jun. 4, 2009

Related U.S. Application Data

(63) Continuation of application No. PCT/GB2007/002889, filed on Jul. 31, 2007.

(30) Foreign Application Priority Data

Aug. 4, 2006 (GB) ..... 0615495.9

(51) Int. Cl.
*F02D 23/00* (2006.01)
*F01D 17/12* (2006.01)
*F01D 17/14* (2006.01)

(52) U.S. Cl. ..... 60/602; 415/163; 415/158; 415/159

(58) Field of Classification Search ..... 60/602; 415/157–164, 914; 416/236 R; *F01D 17/14, F01D 17/16, 9/02, 9/04*
See application file for complete search history.

(56) References Cited

U.S. PATENT DOCUMENTS

| | | | | |
|---|---|---|---|---|
| 3,645,645 | A * | 2/1972 | Gammill et al. | 415/163 |
| 4,403,914 | A | 9/1983 | Rogo et al. | 415/165 |
| 4,720,239 | A * | 1/1988 | Owczarek | 416/236 R |
| 6,932,565 | B2 * | 8/2005 | Garrett et al. | 415/158 |
| 2005/0060999 | A1 | 3/2005 | Mulloy et al. | 60/602 |
| 2009/0097969 | A1 * | 4/2009 | Spuler | 415/159 |
| 2010/0104423 | A1 * | 4/2010 | Severin et al. | 415/159 |

FOREIGN PATENT DOCUMENTS

| | | | | |
|---|---|---|---|---|
| EP | 0654587 | | 5/1995 | |
| EP | 1375826 | | 1/2004 | |
| GB | 2032048 | A * | 4/1980 | 415/914 |
| GB | 2413830 | | 11/2005 | |
| GB | 0615495.9 | | 11/2006 | |
| JP | 2003056406 | A * | 2/2003 | |

OTHER PUBLICATIONS

WO 2008/015406 (ISR), Feb. 7, 2008, Cummins Turbo Tech.

* cited by examiner

*Primary Examiner* — Thai Ba Trieu
(74) *Attorney, Agent, or Firm* — Krieg DeVault LLP; J. Bruce Schelkopf, Esq.

(57) ABSTRACT

A variable geometry turbine comprises a turbine wheel supported in a housing for rotation about a turbine axis with an annular inlet passageway defined between a radial face of a nozzle ring and a facing wall of the housing. The nozzle ring is movable along the turbine axis to vary the width of the inlet passageway and of vanes that are received in corresponding slots in the facing wall. Each vane major surface such that at a predetermined axial position of the nozzle ring relative to the facing wall the recess is in axial alignment with the slot and affords an exhaust gas leakage path through the inlet passageway. The recess is configured to reduce the efficiency of the turbine at small inlet gaps appropriate to engine braking or exhaust gas heating modes.

24 Claims, 4 Drawing Sheets

Moving first and second walls relative to each other

Bringing a recess of a vane into substantial alignment an opening in one of the walls Determination of an exhaust gas temperature falling below a threshold temperature Wherein determination includes determination of a temperature in an exhaust gas of an after-treatment system

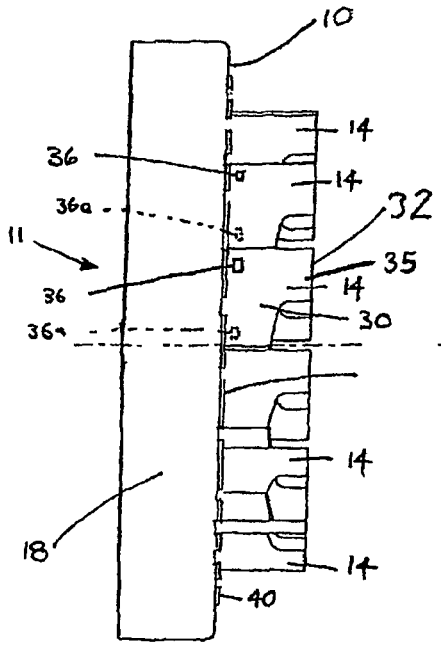
FIG 7
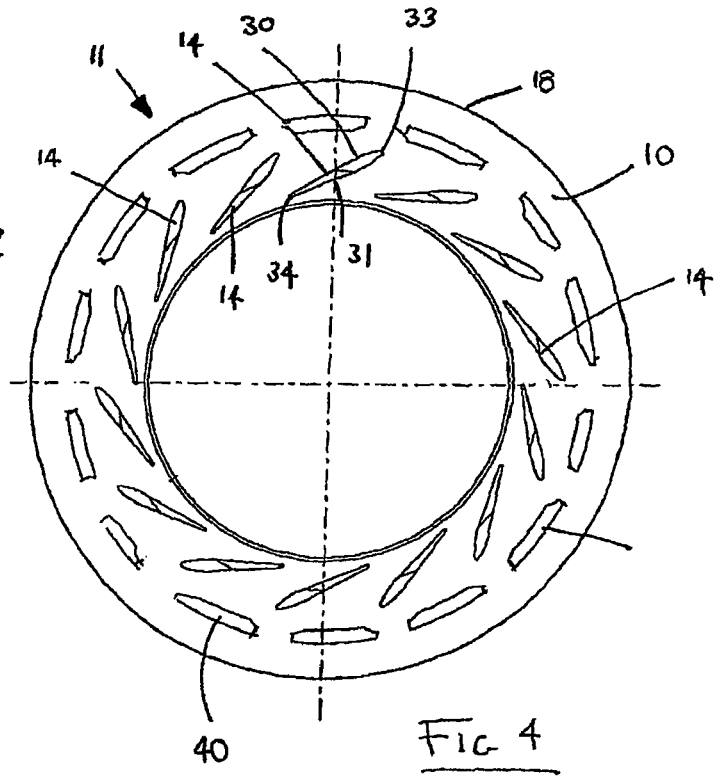
FIG 4
FIGURE 5
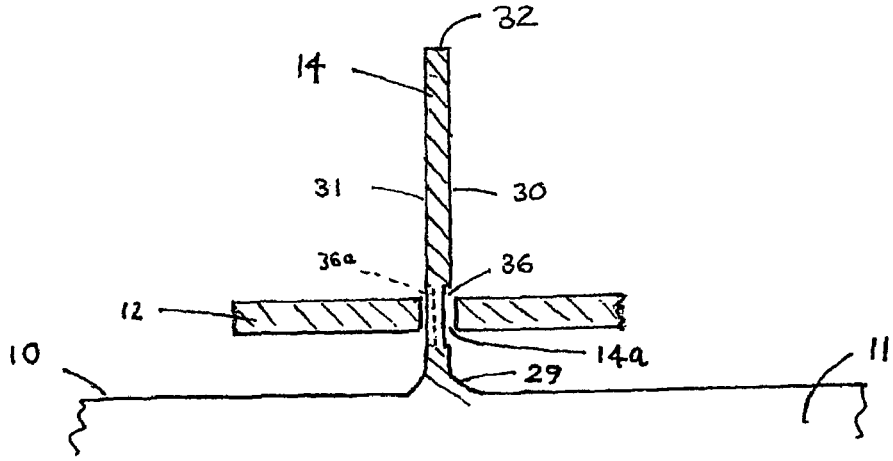

VARIABLE GEOMETRY TURBINE

CROSS REFERECE TO RELATED APPLICATIONS

The present application is a continuation of PCT/GB2007/002889 filed Jul. 31, 2007 which claims priority to United Kingdom Patent Application No. GB0615495.9, filed Aug. 4, 2006, each of which is incorporated herein by reference.

TECHNICAL FIELD

The present invention relates to a variable geometry turbine and to methods of controlling a variable geometry turbine. More particularly, but not exclusively, it relates to a variable geometry turbocharger and to such a turbocharger operated to control engine braking or to affect the exhaust gas temperature of an internal combustion engine.

BACKGROUND

Turbochargers are well known devices for supplying air to the intake of an internal combustion engine at pressures above atmospheric pressure (boost pressures). A conventional turbocharger essentially comprises an exhaust gas driven turbine wheel mounted on a rotatable shaft within a turbine housing connected downstream of an engine outlet manifold. Rotation of the turbine wheel rotates a compressor wheel mounted on the other end of the shaft within a compressor housing. The compressor wheel delivers compressed air to the engine intake manifold. The turbocharger shaft is conventionally supported by journal and thrust bearings, including appropriate lubricating systems, located within a central bearing housing connected between the turbine and compressor wheel housings.

The turbine stage of a conventional turbocharger comprises: a turbine housing defining a turbine chamber within which the turbine wheel is mounted; an annular inlet passageway defined in the housing between facing radially extending walls arranged around the turbine chamber; an inlet arranged around the inlet passageway; and an outlet passageway extending from the turbine chamber. The passageways and chamber communicate such that pressurised exhaust gas admitted to the inlet flows through the inlet passageway to the outlet passageway via the turbine chamber and rotates the turbine wheel. It is known to improve turbine performance by providing vanes in the inlet passageway so as to deflect gas flowing through the inlet passageway towards the direction of rotation of the turbine wheel.

Turbines of this kind may be of a fixed or variable geometry type. Variable geometry turbines differ from fixed geometry turbines in that the size of the inlet passageway can be varied to optimise gas flow velocities over a range of mass flow rates so that the power output of the turbine can be varied to in line with varying engine demands. For instance, when the volume of exhaust gas being delivered to the turbine inlet is relatively low, the velocity of the gas reaching the turbine wheel is maintained at a level that ensures efficient turbine operation by reducing the size of the annular inlet passageway. Turbochargers provided with a variable geometry turbine are referred to as variable geometry turbochargers.

In one known type of variable geometry turbine, an axially moveable wall member, generally referred to as a "nozzle ring", defines one wall of the inlet passageway. The position of the nozzle ring relative to a facing wall of the inlet passageway is adjustable to control the axial width of the inlet passageway. Thus, for example, as exhaust gas flow through the turbine decreases, the inlet passageway width may be decreased to maintain the gas velocity and optimise turbine output. This arrangement differs from another type of variable geometry turbine in which a variable guide vane array comprises adjustable swing guide vanes arranged to pivot so as to open and close the inlet passageway.

The nozzle ring may be provided with vanes that extend into the inlet passageway and through slots provided in a "shroud" plate defining a fixed facing wall of the inlet passageway, the slots being designed to accommodate movement of the nozzle ring relative to the shroud. Alternatively, vanes may extend from the fixed facing wall and through slots provided in the nozzle ring.

Typically the nozzle ring may comprise a radially extending wall (defining one wall of the inlet passageway) and radially inner and outer axially extending walls or flanges that extend into an annular cavity behind the radial face of the nozzle ring. The cavity is formed in a part of the turbocharger housing (usually either the turbine housing or the turbocharger bearing housing) and accommodates axial movement of the nozzle ring. The flanges may be sealed with respect to the cavity walls to reduce or prevent leakage flow around the back of the nozzle ring. In one common arrangement the nozzle ring is supported on rods extending parallel to the axis of rotation of the turbine wheel and is moved by an actuator, which axially displaces the rods.

One example of a variable geometry turbocharger is disclosed in EP 0654587, which discloses a nozzle ring that is additionally provided with pressure balancing apertures through its radial wall. The pressure balancing apertures ensure that pressure within the nozzle ring cavity behind the nozzle ring is substantially equal to, but always slightly less than, the pressure applied to the nozzle ring face by gas flow through the inlet passageway. This ensures that there is only a small unidirectional force on the nozzle ring which aids accurate adjustment of the nozzle ring position, particularly when the nozzle ring is moved close to the opposing wall of the inlet to reduce the inlet passageway towards its minimum width.

In addition to the conventional control of a variable geometry turbocharger in an engine fired mode (in which fuel is supplied to the engine for combustion) to optimise gas flow, it is also known to take advantage of the facility to minimise the turbocharger inlet area to provide an engine braking function in an engine braking mode (in which no fuel is supplied for combustion) in which the inlet passageway is reduced to smaller areas compared to those in a normal engine fired mode operating range.

Engine brake systems of various forms are widely fitted to vehicle engine systems, in particular to compression ignition engines (diesel engines) used to power large vehicles such as trucks. The engine brake systems may be employed to enhance the effect of the conventional friction brakes acting on the vehicle wheels or, in some circumstances, may be used independently of the normal friction braking system, to control, for example, the downhill speed of a vehicle. With some engine brake systems, the brake is set to activate automatically when the engine throttle is closed (i.e. when the driver lifts his foot from the throttle pedal), and in others the engine brake may require manual activation by the driver, such as depression of a separate brake pedal.

In one form of conventional engine brake system an exhaust valve in the exhaust line is controlled to block partially the engine exhaust when braking is required. This produces an engine braking torque by generating a high backpressure that retards the engine by serving to increase the work done on the engine piston during the exhaust stroke. This braking effect is transmitted to the vehicle wheels through the vehicle drive chain. U.S. Pat. No. 4,526,004 discloses such an engine braking system for a turbocharged engine in which the exhaust valve is provided in the turbine housing of a fixed geometry turbocharger.

With a variable geometry turbine, it is not necessary to provide a separate exhaust valve. Rather, the turbine inlet passageway may simply be "closed" to a minimum flow area when braking is required. The level of braking may be modulated by control of the inlet passageway size by appropriate control of the axial position of the nozzle ring. In a "fully closed" position in an engine braking mode the nozzle ring may in some cases abut the facing wall of the inlet passage. In some exhaust brake systems known as decompression brake systems, an in-cylinder decompression valve arrangement is controlled to release compressed air from the engine cylinder into the exhaust system to release work done by the compression process. In such systems closure of the turbine inlet both increases back pressure and provides boost pressure to maximise compression work.

It is important to allow some exhaust gas flow through the engine during engine braking in order to prevent excessive heat generation in the engine cylinders. Thus there must be provision for at least a minimum leakage flow through the turbine when the nozzle ring is in a fully closed position in an engine braking mode. In addition, the high efficiency of modem variable geometry turbochargers can generate such high boost pressures even at small inlet widths that their use in an engine braking mode can be problematic as cylinder pressures can approach, or exceed, acceptable limits unless countermeasures are taken (or braking efficiency is sacrificed). This can be a particular problem with engine brake systems including a decompression braking arrangement.

An example of a variable geometry turbocharger which includes measures for preventing generation of excessive pressures in the engine cylinders when operated in an engine braking mode is disclosed in EP 1435434. This discloses a nozzle ring arrangement having bypass apertures that provide a bypass path that opens when the nozzle ring approaches a closed position to allow some exhaust gas to flow from the turbine inlet to the turbine wheel through the nozzle ring cavity thereby bypassing the inlet passageway. The bypass gas flow does less work on the turbine wheel than gas flowing through the inlet passageway so that with the bypass passageway open the turbine efficiency drops preventing excessive pressure generation within the engine cylinders. In addition, the bypass gas flow can provide, or contribute to, the minimum flow required to avoid excessive heat generation during engine braking.

It is also known to operate a variable geometry turbocharger in an engine fired mode so as to close the inlet passageway to a minimum width less than the smallest width appropriate for normal engine operating conditions in order to control exhaust gas temperature. The basic principle of operation in such an "exhaust gas heating mode" is to reduce the amount of airflow through the engine for a given fuel supply level (whilst maintaining sufficient airflow for combustion) in order to increase the exhaust gas temperature. This has particular application where a catalytic exhaust after-treatment system is present. In such a system performance is directly related to the temperature of the exhaust gas that passes through it. To achieve a desirable performance the exhaust gas temperature must be above a threshold temperature (typically lying in a range of about 250° C. to 370° C.) under all engine operating conditions and ambient conditions. Operation of the exhaust gas after-treatment system below the threshold temperature range will cause the system to build up undesirable accumulations which must be burnt off in a regeneration cycle to allow the system to return to designed performance levels. In addition, prolonged operation of the exhaust gas after-treatment system below the threshold temperature without regeneration will disable the system and cause the engine to become non-compliant with government exhaust emission regulations.

For the majority of the operating range of, for example, a diesel engine, the exhaust gas temperature will generally be above the required threshold temperature. However, in some conditions, such as light load conditions and/or cold ambient temperature conditions, the exhaust gas temperature can often fall below the threshold temperature. In such conditions the turbocharger can in principle be operated in the exhaust gas heating mode to reduce the turbine inlet passageway width with the aim of restricting airflow thereby reducing the airflow cooling effect and increasing exhaust gas temperature. However a potential problem with the operation of a modem efficient turbocharger in this way is that increased boost pressures achieved at small inlet widths can actually increase the airflow offsetting the effect of the restriction, thus reducing the heating effect and possibly preventing any significant heating at all.

The above problems with exhaust gas heating mode operation of a variable geometry turbocharger are addressed in US published patent application No. US2005/0060999A1. This teaches using the turbocharger nozzle ring arrangement of EP 1435434 (mentioned above) in an exhaust gas heating mode. The bypass gas path is arranged to open at inlet passageway widths smaller than those appropriate to normal fired mode operation conditions but which are appropriate to operation in an exhaust gas heating mode. As in braking mode, the bypass gas flow reduces turbine efficiency thus avoiding high boost pressures, which might otherwise counter the heating effect. In addition to the bypass gas path, pressure balancing apertures (as disclosed in EP 0654587, mentioned above) may be provided to aid control of the nozzle ring position in an exhaust gas heating mode.

Whether operated in an engine braking mode (with or without a decompression brake system) or an exhaust gas heating mode, control of the nozzle ring position at very small inlet widths can be problematic as there can be a rapid increase in the load on the nozzle ring as it approaches a closed position. Even with the provision of pressure balancing apertures as mentioned above there can be a tendency for the nozzle ring to "snap" shut as it approaches close to the opposing wall of the inlet. In addition it can require a very large force to open a nozzle ring, which abuts the opposing wall of the inlet when in a fully closed position. It can also be difficult to ensure that there is always an optimum minimum flow through the turbine when the nozzle ring is in a fully closed position.

SUMMARY

It is an object of some embodiments of the present invention to provide an improved or an alternative variable geometry turbocharger.

According to a first aspect of the present invention there is provided a variable geometry turbine comprising;

a turbine wheel supported in a housing for rotation about a turbine axis;

a substantially annular or annular inlet passageway defined between a substantially radial or radial face of a first wall and a facing second wall of the housing, the walls being movable relative to one another along the turbine axis to vary the size of the inlet passageway;

a substantially annular array of vanes extending across said inlet passageway and defining vane surfaces, vane passages being defined between the vanes for directing exhaust gas flow between adjacent vane surfaces towards the turbine wheel, each vane being fixed to said first wall and a respective opening for receiving the vane being provided in the second wall to accommodate said relative movement of the walls, at least one vane having at least one recess in a vane surface such that when the walls are in a predetermined position the recess is substantially aligned with its respective opening so that it affords a clearance between the vane and the second wall so as to provide an exhaust gas leakage flow path.

The term "radial face" is intended to mean a face that extends in a generally radial direction and does not exclude such a face having a small axial component.

The predetermined position may be one in which the annular inlet passageway is substantially closed.

The walls may be movable between a first position in which first and second walls are spaced apart to define a relatively wide annular inlet passageway and a second position in which the first and second walls are proximate so as to define a relatively narrow annular inlet passageway in which the recess is substantially aligned with its respective opening it affords a clearance between the vane and the second wall so as to provide an exhaust gas leakage flow path.

The second wall may also have vanes fixed thereto and the first wall may have corresponding openings for receiving the respective vanes.

In one embodiment the first wall is movable along said axis and the second wall is fixed. Alternatively the first wall may be fixed and the second wall movable. As a further alternative both walls may be movable along said axis.

The recess may be provided proximate to the wall from which the vane extends.

The vanes may have first and second major surfaces with at least one recess being provided on each of those surfaces. The vanes may each have a radially outer leading edge and a radially inner trailing edge. A first recess may be provided on said first surface adjacent to a leading edge of the vane whereas a second recess may be provided on said second surface adjacent to a trailing edge of the vane. Alternatively, the recesses may be provided on one of the first and second major surfaces. There may be provided a plurality of recesses on one or both of the vane surfaces. These may be axially spread across the vane.

The second wall may extend in any suitable direction provided it is facing the first wall so as to define the inlet passageway and the opening in the wall can receive the vane. The second wall may be defined by a shroud plate. The first wall may be a nozzle ring.

The openings may be in the form of slots. Each slot may be designed to receive a respective vane in a snug fit so as to seal against the passage of gas between them.

A generally annular rib may be provided on said face of the first or second wall such that the minimum width of the inlet passageway is defined between the rib and a portion of the facing wall. The rib may be perforated or discontinuous so that it provides at least one gas passage when it is in contact with the other wall to allow gas to flow to the annular inlet passageway. The rib may circumscribe said inlet vanes. In the second position the perforated or discontinuous rib abuts said portion of the other wall.

According to a second aspect of the present invention there is provided a turbocharger comprising a variable geometry turbine as defined above and drivingly connected to a compressor.

According to a third aspect of the present invention there is provided a method for operating a turbocharger, as defined above and fitted to an internal combustion engine, in an engine braking mode in which a fuel supply to the engine is stopped and the walls are moved to reduce the width of the turbine inlet passageway. In said engine braking mode the walls are moved to said predetermined position to allow the exhaust gas leakage According to a fourth aspect of the present invention there is provided a method operating a turbocharger, as defined above and fitted to an internal combustion engine, in an exhaust gas heating mode in which the annular inlet passageway is reduced below a width appropriate to a normal engine operating range to raise the temperature of exhaust gas passing through the turbine.

In said exhaust gas heating mode the first and/or second walls are moved to reduce the size of the annular inlet passageway for exhaust gas heating in response to determination of the exhaust gas temperature falling below a threshold temperature. The method may further comprise the step of passing the exhaust gas from the variable geometry turbine to an after-treatment system, wherein determination of the exhaust gas temperature includes determination of the temperature of the exhaust gas in the after-treatment system, and wherein said threshold temperature is a threshold temperature condition of the exhaust gas in the after-treatment system.

The provision of the recess or recesses ensures a minimum leakage gas flow through the inlet. For instance, where the turbine forms part of a turbocharger fitted to an internal combustion engine, provision of a minimum gas flow when the walls are moved to the predetermined position allows the movable wall member to be moved in to the fully closed position in an exhaust gas heating or engine braking mode as described more fully below.

The turbine according to the present invention may include structure to provide for a bypass gas flow around the inlet when the nozzle ring is in a closed position to reduce efficiency of the turbine as taught in EP 1 435 434.

Similarly, the moveable annular wall member may be provided with pressure balancing holes as disclosed in EP 0 654 587 mentioned above. In some embodiments the pressure balancing holes may be combined with bypass passage structure as taught in EP 1 435 434.

Other preferred and advantageous features of the various aspects of the present invention will be apparent from the following description.

BRIEF DESCRIPTION OF THE FIGURES

A specific embodiment of the present invention will now be described, by way of example only, with reference to the accompany drawings, in which:

FIG. 3 is a side view of the full nozzle ring of FIGS. 1 and 2;

FIG. 4 is a front view of the nozzle ring of FIG. 3; and

FIG. 5 is a sectioned view of the nozzle ring along line A-A of FIG. 2*b*, illustrating a single vane and slot.

DETAILED DESCRIPTION

Figure 1:
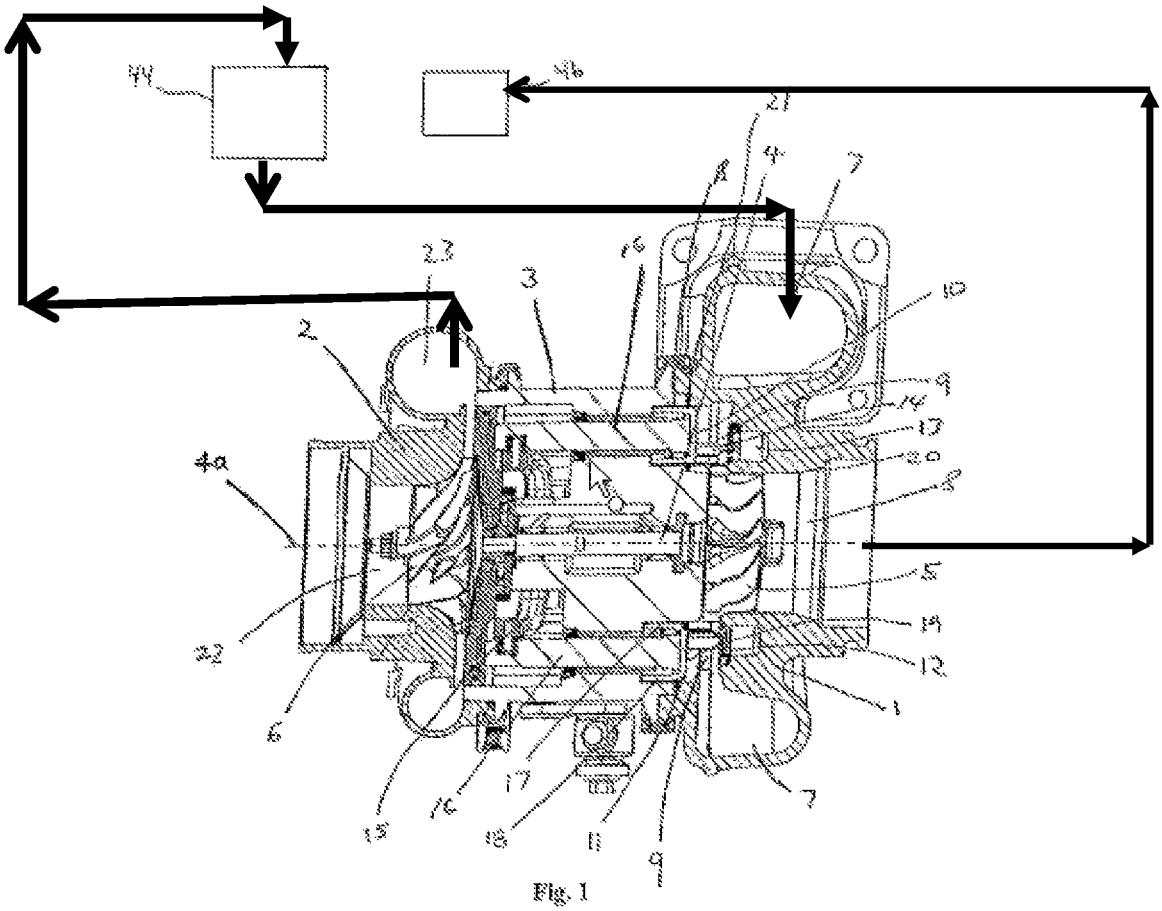
FIG. 1 is an axial cross-section through a variable geometry turbocharger in accordance with the present invention.

Referring now to the figures, the exemplary variable geometry turbocharger comprises a variable geometry turbine housing 1 and a compressor housing 2 interconnected by a central bearing housing 3. A turbocharger shaft 4 extends from the turbine housing 1 to the compressor housing 2 through the bearing housing 3. A turbine wheel 5 is mounted on one end of the shaft 4 for rotation within the turbine housing 1, and a compressor wheel 6 is mounted on the other end of the shaft 4 for rotation within the compressor housing 2. The shaft 4 rotates about turbocharger axis 4*a* on bearing assemblies located in the bearing housing.

The turbine housing 1 defines an inlet chamber 7 (typically a volute) to which exhaust gas from an internal combustion engine (not shown) is delivered. The exhaust gas flows from the inlet chamber 7 to an axially extending outlet passageway 8 via an annular inlet passageway 9 and turbine wheel 5. The inlet passageway 9 is defined on one side by the face 10 of a radial wall of a movable annular wall member 11, commonly referred to as a "nozzle ring", and on the opposite side by an annular shroud plate 12 which forms the wall of the inlet passageway 9 facing the nozzle ring 11. The shroud plate 12 covers the opening of an annular recess 13 in the turbine housing 1.

The nozzle ring 11 supports an array of circumferentially and equally spaced inlet vanes 14 each of which extends axially across the inlet passageway 9. The vanes 14 are orientated to deflect gas flowing through the inlet passageway 9 towards the direction of rotation of the turbine wheel 5, as is best seen in FIG. 4. When the nozzle ring 11 is proximate to the annular shroud plate 12, the vanes 14 project through suitably configured slots 14*a* in the shroud plate 12, into the recess 13. The vanes seal against the edges defining the slots so as to prevent any significant flow of gas into the recess 13 when the nozzle ring 11 is proximate the shroud plate 12.

An actuator (not shown) is operable to control the position of the nozzle ring 11 via an actuator output shaft (not shown), which is linked to a stirrup member 15. The stirrup member 15 in turn engages axially extending guide rods 16 that support the nozzle ring 11. Accordingly, by appropriate control of the actuator (which may for instance be pneumatic, hydraulic or electric), the axial position of the guide rods 16 and thus of the nozzle ring 11 can be controlled. It will be appreciated that details of the nozzle ring mounting and guide arrangements may differ from those illustrated.

The nozzle ring 11 has axially extending radially inner and outer annular flanges 17 and 18 that extend into an annular cavity 19 provided in the turbine housing 1 and the bearing housing 3. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19 in an axial direction. The inner sealing ring 21 is supported within an annular groove formed in the radially inner annular surface of the cavity 19 and bears against the inner annular flange 17 of the nozzle ring 11. The outer sealing ring 20 is supported within an annular groove formed in the radially outer annular surface of the cavity 19 and bears against the outer annular flange 18 of the nozzle ring 11. It will be appreciated that the inner and/or outer sealing rings could be mounted in a respective annular groove in the nozzle ring flanges rather than as shown.

Exhaust gas flowing from the inlet chamber 7 to the outlet passageway 8 passes over the turbine wheel 5 causing it to rotate and, as a result, torque is applied to the shaft 4 to drive the compressor wheel 6. Rotation of the compressor wheel 6 within the compressor housing 2 pressurises ambient air present in an air inlet 22 and delivers the pressurised air to an air outlet volute 23 from which it is fed to an internal combustion engine (not shown). The speed of the turbine wheel 5 is dependent upon the velocity of the gas passing through the annular inlet passageway 9. For a fixed rate of mass of gas flowing into the inlet passageway, the gas velocity is a function of the gap between the nozzle ring 11 and the shroud 12 that defines the passageway 9 and is adjustable by controlling the axial position of the nozzle ring 11 (as the inlet passageway 9 gap is reduced, the velocity of the gas passing through it increases). In FIG. 1 the annular inlet passageway 9 is shown fully open. The inlet passageway 9 may be closed to a minimum gap appropriate to different operating modes by moving the face 10 of the nozzle ring 11 towards the shroud plate 12.

The vanes 14 are joined to the nozzle ring at a "root" 29 and define first and second major surfaces 30, 31 (best viewed in FIG. 4) that extend, in a first generally axial direction, between the root 29 and an axially distal tip 32. The axial length of each vane 14 is referred to as its height, whereas the vane width, or chord length, is the distance between leading and trailing edges 33, 34 relative to the radial flow of the exhaust gas passing through the inlet passageway 9. The major surfaces 30,31 extend between the leading and trailing edges 33, 34 and are generally smooth and continuous. The first major surface 30 faces generally towards the incoming gas and is often referred to as the low pressure face, whereas the second major surface 31 faces in the opposite direction and is referred to as the high pressure face. It will be apparent from FIG. 2*b* that each is cut away to define a nose portion 35 of reduced height and chord length.

Each of the low pressure and high pressure surfaces 30, 31 has a recess 36 therein adjacent to the vane root 29. In the exemplary embodiment shown (best seen in FIG. 2*a*) a first recess 36 is defined in the low pressure surface 30 adjacent to the leading edge 33 and a second recess 36*a* is defined in the high pressure surface 31 adjacent to the trailing edge 34. The recesses 36, 36*a* can be formed by machining away material from the surfaces or as part of a casting or other suitable forming process. They may take any suitable form such as, for example, indentations, grooves or channels. The exact number, size and shape of the recesses 36 depends on the particular requirements of the turbocharger but in this application the two recesses 36, 36*a* are configured so that when the nozzle ring face 10 is around 4 mm from the shroud plate 12 the recesses 36, 36*a* are axially coincident with the slots 14*a* so as to provide a clearance between the vane 14 and the edge of the slots 14*a* thereby providing an gas leakage flow path. The recesses 36, 36*a* have generally smooth surfaces to allow non-turbulent gas flow across them.

Figure 2A:
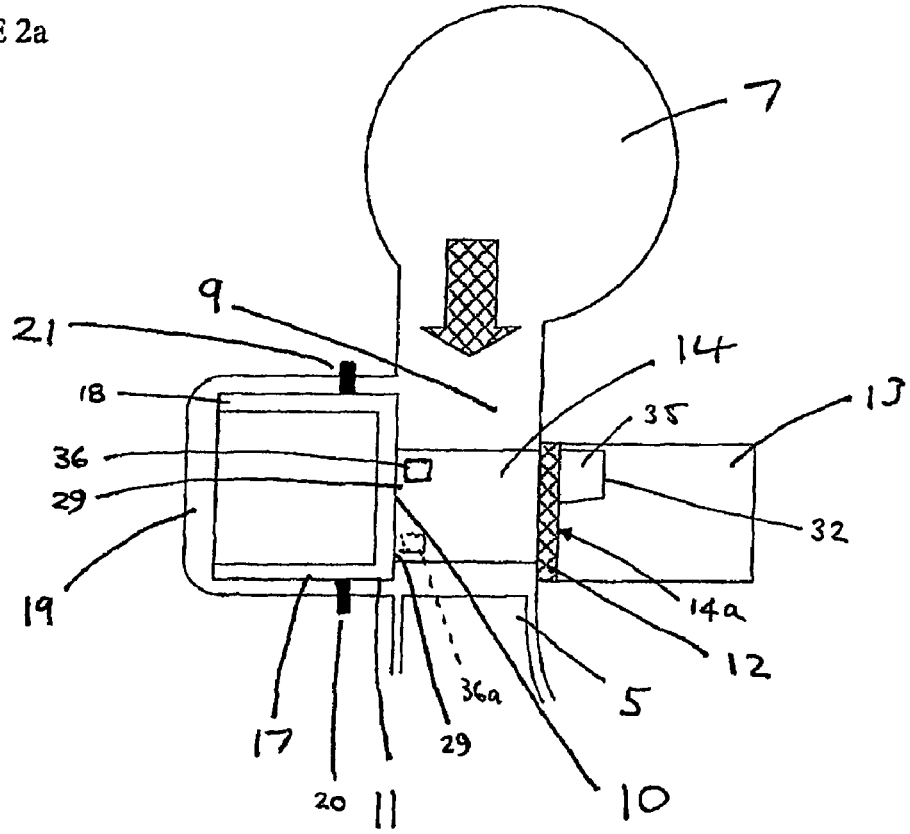
FIGS. 2*a* and 2*b* are schematic cross-sections through part of a variable geometry turbine inlet structure illustrating part of a nozzle ring in accordance with the present invention.
Figure 2B:
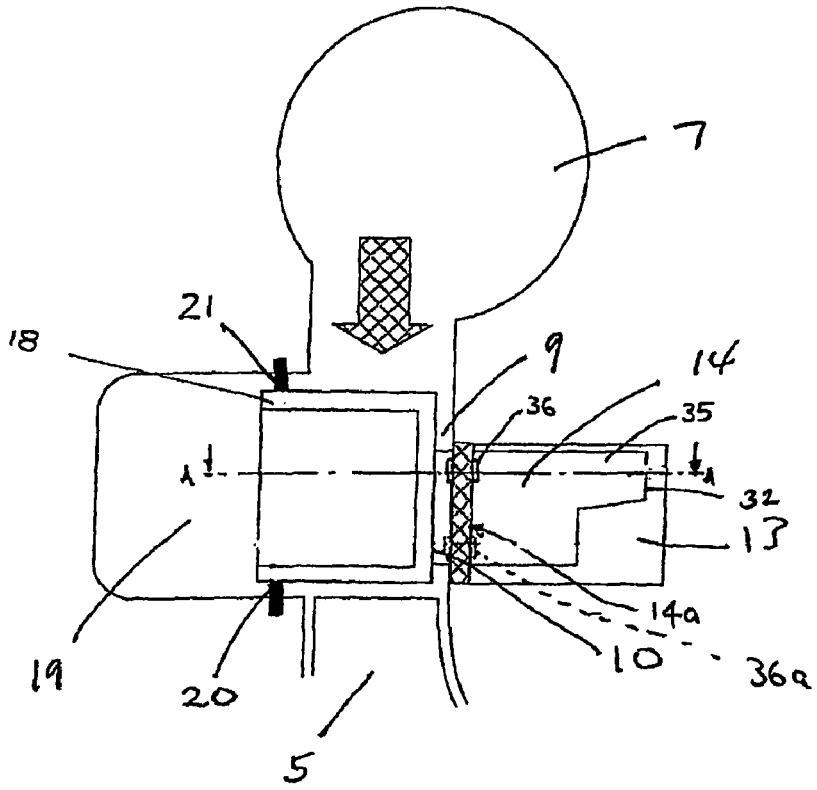
Figure 6:
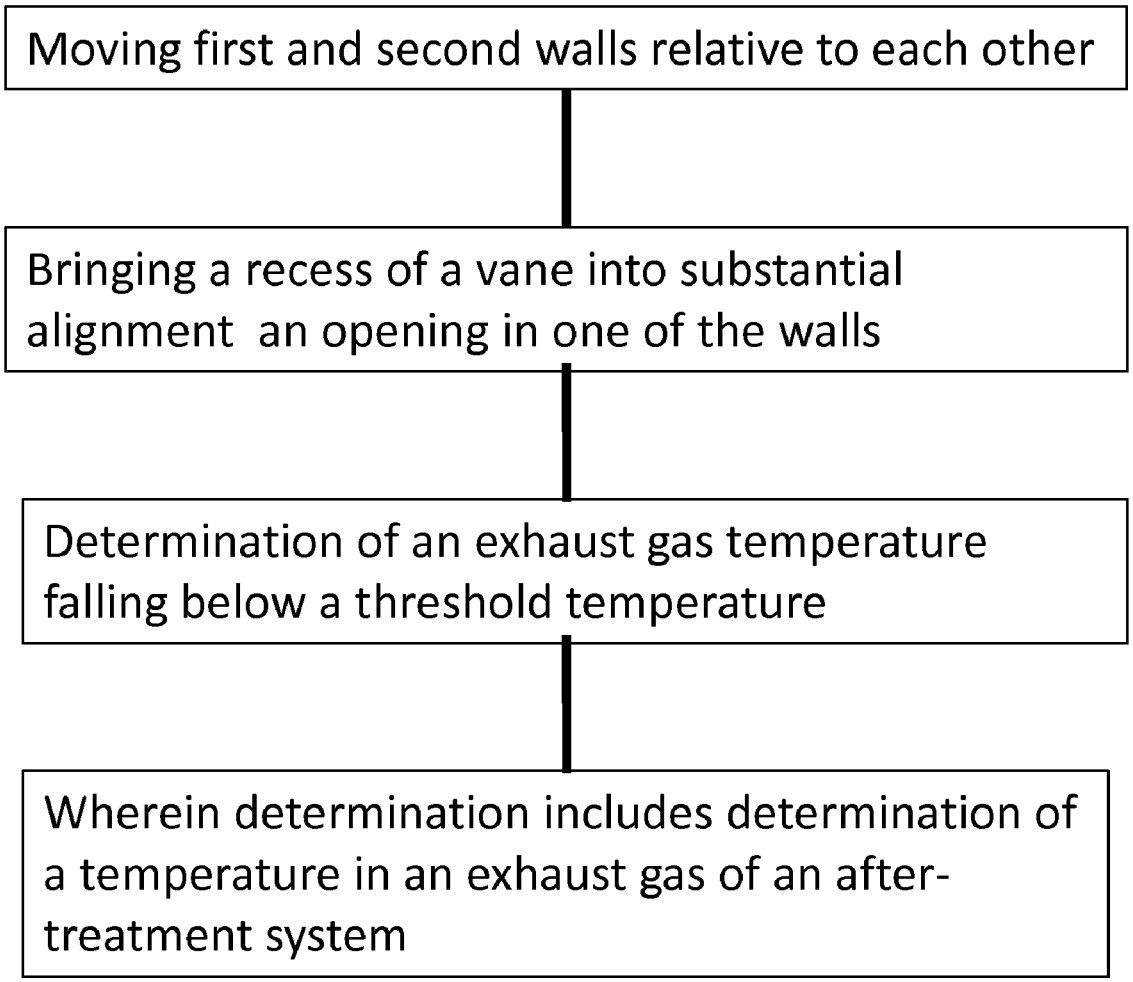
FIG. 6 depicts one embodiment of a method.

In FIG. 2*a* the nozzle ring 11 is shown in an open position so that the inlet passageway 9 defined by the gap between the nozzle ring face 10 and the shroud 12 is relatively large. The position shown is not necessarily the 'fully' open position, as in some turbochargers it may be possible to withdraw the nozzle ring 11 further into the nozzle ring cavity 19. In FIGS. 2*b* and 5 the nozzle ring 11 is shown in a substantially "closed" position in which the face 10 of the nozzle ring 11 is moved close to the shroud 12 to reduce the inlet passageway 9 towards a minimum. Here the recesses 36, 36*a* are brought into alignment with the shroud plate slots 14*a* so that each provides a clearance between the vane and the shroud plate through which exhaust gas may escape. In the example shown the exhaust gas leaks past the shroud plate 12 on the low pressure side 30 via recess 36 and passes over the vane tip 32 to the recess 36*a* on the high pressure side from where it can escape to the turbine wheel 5. The recesses thus provide leak flow paths when the nozzle ring is at or near the "closed"

position. It will be appreciated that a single recess that provides a leak path across the vane would suffice in some applications.

As mentioned above, in an engine braking mode or exhaust gas heating mode at least a small flow of exhaust gas is required when the inlet passageway 9 is closed to its minimum gap. This is achieved by ensuring that the leak flow paths provided by the vane recesses 36, 36*a* come into operation when the nozzle ring 11 is in the "closed" position and the inlet gap is a minimum. The recesses 36, 36*a* are designed such that the minimum flow is not too large or the braking efficiency or exhaust gas heating effect may be compromised. In effect, the recesses allow the inlet passageway 9 size to be locally increased when the gap between the shroud 12 and nozzle ring face 10 is at or near the minimum.

In an engine braking mode fuel supplied to the engine is stopped and the nozzle ring 11 is moved so that the turbine inlet 9 is closed down to a gap that will generally be much smaller than the minimum gap appropriate to normal engine fired mode operation. The minimum gap of the inlet at its "closed" position still allows sufficient flow of exhaust gas to avoid generating excessive boost pressures and over pressurizing the engine cylinders.

In an exhaust gas heating mode the nozzle ring 11 is moved to reduce the size of the inlet passageway 9 in response to the temperature within an exhaust gas after-treatment system (e.g. a catalytic converter) dropping below a threshold temperature.

The temperature within the after-treatment system may be determined, for example, by a temperature detector, which may either operate to detect the gas temperature at discrete time intervals or in a continuous or almost continuous manner. If, during fired mode operation, the temperature within the after-treatment system (an example of which is shown as reference numeral 46 in FIG. 1, which also discloses an internal combustion engine 44) is determined to be below a threshold value the nozzle ring 11 is moved to reduce the inlet gap to restrict air flow sufficiently to cause the exhaust gas temperature to rise without preventing the air flow necessary for combustion within the engine cylinders. The nozzle ring 11 may be maintained at the minimum gap position in which the recesses 36,36*a* or, if the inlet gap is smaller or larger than that required for engine braking, other recesses at alternative positions provide the leakage paths, until the detected temperature is at or above the threshold temperature. This inlet gap 9 will generally be below the minimum gap appropriate to a normal fired mode operation.

As discussed above, the closed position of the nozzle ring 11, and hence the minimum gap of the inlet passageway 9, may vary between the different operating modes. For instance, in a normal fired operating mode the minimum inlet gap may be relatively large, typically of the order of 3-12 millimetres. However in an engine braking mode or exhaust gas heating mode the minimum gap will generally be less than the minimum gap used in normal fired mode. Typically, the minimum gap in an engine braking mode or exhaust gas heating mode will be less than 4 millimetres. It will, however, be appreciated that the size of the minimum gap will to some extent be dependent upon the size and configuration of the turbine. Typically, the minimum gap for a turbine inlet for an engine operating in normal fired mode will not be less than about 25% of the maximum inlet gap, but will typically be less than 25% of the maximum gap in an engine braking or exhaust gas heating mode.

It will be appreciated that although closure of the turbine inlet during engine exhaust gas heating 9 is quite different to the effect of closing the inlet during engine braking, similar problems are encountered. There is a need to avoid excessive engine cylinder pressures and temperatures; the requirement to accurately control the position of the nozzle ring at very small inlet passageway gaps at which the load balance on the nozzle ring can be sensitive to nozzle ring movement; and the desire to control in a predictable manner, and to optimise, the level of the minimum gas flow through the turbine when the inlet is closed to a minimum. Moreover, in engine braking mode it may be necessary for the nozzle ring 11 to be maintained at a minimum inlet gap position for a prolonged period of time, such as for instance when the engine brake is used to control the speed of a large vehicle travelling on a long downhill descent. Similarly, the nozzle ring may have to be held at a minimum gap inlet suitable for exhaust gap heating mode for sustained periods. For these reasons, the nozzle ring may optionally include a perforated or discontinuous annular rib 40 extending axially from the face 10 of the nozzle ring 11 circumscribing the inlet vanes 14 as shown in FIGS. 3 and 4 and as is described in our co-pending UK patent application no. 0521354.4. Fully closing the nozzle ring 11 such that the annular rib 40 comes into contact with the shroud plate 12 in an engine braking or exhaust gas heating mode avoids the problem of having to hold the ring 11 away from the shroud plate which requires finely balancing the nozzle ring actuating force with a load on the face 10 resulting from gas pressure in the inlet. When the annular rib 40 contacts the shroud plate 12 the exhaust gas is still able to pass through the discontinuities or perforations defined in the rib 40 and through the recesses 36, 36*a* in the vanes 14 so as to provide a fixed minimum leakage flow area that is defined independently of the minimum inlet gap 9. Thus the provision of the annular rib 40 allows for improved positional control of the nozzle ring 11.

With the provision of the annular rib 40 it is not necessary to take any other measure, or to provide any other structure, in order to ensure a minimum gas flow through the turbine when the turbocharger is operated in an exhaust gas heating or engine braking mode and the nozzle ring 11 is in a fully closed position. Control over the position of the nozzle ring 11 is improved, since the nozzle ring may be fully closed in an engine braking or exhaust heating mode, and in addition the size of the leakage flow path is precisely defined by the recesses 36, 36*a*.

It is to be understood that in some applications the annular rib 40 may still be used to control the size of the inlet gap 9 even if the nozzle ring 11 is not fully closed i.e. the rib 40 is spaced from the shroud plate 12 and the minimum inlet passageway 9 is defined between the rib 40 and the shroud plate 12. In such applications the rib may be solid. Again this is described in our co-pending UK patent application no. 0521354.4.

In both the engine braking and exhaust gas heating modes, high turbine efficiency can be problematic when operating the turbocharger at a small turbine inlet size in an exhaust heating mode. The leakage paths offered by the recesses 36, 36*a* are configured to reduce the efficiency of the turbine at small inlet gaps appropriate to engine braking or exhaust gas heating modes with the advantage described above.

The size of the minimum flow permitted can be varied between different applications by variation of such parameters as the size, depth, number and location of the recesses 36, 36*a*.

It will be appreciated that the nozzle ring may be modified by the provision of pressure balance holes to provide the further advantages as disclosed in EP 0654587.

It is to be appreciated that numerous modifications to the above described embodiments may be made without departing from the scope of the invention as defined in the appended claims. For example, the exact shape and configuration of the nozzle ring, shroud and vanes may differ depending on the application.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A method of operating a turbocharger in an internal combustion engine having a variable geometry turbine and a compressor driven by said turbine, a substantially annular turbine inlet passageway defined between a substantially radial face of a first wall and a facing second wall of the housing, a substantially annular array of turbine vanes extending across said inlet passageway and defining vane surfaces, turbine vane passages being defined between the vanes for directing exhaust gas flow between adjacent vane surfaces towards the turbine wheel, each of said vanes being fixed to said first wall, a respective opening for receiving the each of said vanes being provided in the second wall, and at least one of the turbine vanes having at least one recess formed in a vane surface, the method comprising:

stopping a fuel supply to an internal combustion engine when in an engine braking mode;

moving a first and second wall of the variable geometry turbine relative to one another to reduce a size of the turbine inlet passageway; and substantially aligning the at least one recess formed in the vane surface of the variable geometry turbine with the opening in the second wall for receiving a vane of the first wall so as to provide exhaust gas leakage flow path.

2. A method of operating a turbocharger in an internal combustion engine having a variable geometry turbine and a compressor driven by said turbine, a substantially annular turbine inlet passageway defined between a substantially radial face of a first wall and a facing second wall of the housing, a substantially annular array of turbine vanes extending across said inlet passageway and defining vane surfaces, turbine vane passages being defined between the vanes for directing exhaust gas flow between adjacent vane surfaces towards the turbine wheel, each of said vanes being fixed to said first wall, a respective opening for receiving the each of said vanes being provided in the second wall, and at least one of the turbine vanes having at least one recess formed in a vane surface, the method comprising:

providing exhaust gas in a heating mode, moving the first and second walls relatively to one another to reduce the size of the turbine inlet to less than that required for a normal operating mode, substantially aligning the at least one recess formed in the vane surface of the variable geometry turbine with the opening in the second wall for receiving a vane of the first wall so as to provide exhaust gas leakage flow path; and passing the exhaust gas with an increase in temperature through the turbine.

3. The method of operating a turbocharger in an internal combustion engine according to claim 2, wherein moving said walls relatively to one another to reduce the inlet width for exhaust gas heating in response to determination of the exhaust gas temperature falling below a threshold temperature.

4. The method of operating a turbocharger in an internal combustion engine according to claim 3, further comprising the step of passing the exhaust gas from the variable geometry turbine to an after-treatment system, wherein determination of the exhaust gas temperature includes determination of the temperature of the exhaust gas in the after-treatment system, and wherein said threshold temperature is a threshold temperature condition of the exhaust gas in the after-treatment system.

5. A variable geometry turbine comprising;

a turbine wheel supported in a housing for rotation about a turbine axis;

a substantially annular inlet passageway defined between a substantially radial face of a first wall and a facing second wall of the housing, the walls being movable relative to one another along the turbine axis to vary the size of the inlet passageway;

a substantially annular array of vanes extending across said inlet passageway and defining vane surfaces, vane passages being defined between the vanes for directing exhaust gas flow between adjacent vane surfaces towards the turbine wheel, wherein each of said vanes are fixed to said first wall and a respective opening for receiving the each of said vanes being provided in the second wall to accommodate said relative movement of the walls, wherein at least one of said vanes has at least one recess formed in a vane surface; and wherein the at least one recess is substantially aligned with the respective opening so that the at least one recess affords a clearance between the at least one of said vanes and the second wall so as to provide an exhaust gas leakage flow path when the walls are in a predetermined position.

6. The variable geometry turbine according to claim 5, wherein the walls are movable between a first position in which first and second walls are spaced apart to define a relatively wide annular inlet passageway and a second position in which the first and second walls are proximate so as to define a relatively narrow annular inlet passageway in which the recess is substantially aligned with its respective opening it affords a clearance between the vane and the second wall so as to provide an exhaust gas leakage flow path.

7. The variable geometry turbine according to claim 5, wherein the second wall has vanes fixed thereto and the first wall has corresponding openings for receiving the respective vanes.

8. The variable geometry turbine according to claim 5, wherein the first wall is movable along said axis and the second wall is fixed.

9. The variable geometry turbine according to claims 5, wherein the first wall is fixed and the second wall is movable.

10. The variable geometry turbine according to claim 5, wherein both the first and second walls are movable along said axis.

11. The variable geometry turbine, according to claim 5, wherein the at least one recess is provided proximate to the wall from which the vane extends.

12. The variable geometry turbine according to claim 5, wherein the vanes have first and second major surfaces with at least one recess being provided on each of those surfaces.

13. The variable geometry turbine according to claim 12, wherein the vanes each have a radially outer leading edge and a radially inner trailing edge.

14. The variable geometry turbine according to claim 13, wherein a first recess is provided on said first surface adjacent to a leading edge of the vane and a second recess is provided on said second surface adjacent to a trailing edge of the vane.

15. The variable geometry turbine according to claim 14, wherein a plurality of recesses is provided on one or both of the vane surfaces.

16. The variable geometry turbine according to claim 5, wherein the second wall is defined by a shroud plate.

17. The variable geometry turbine according to claim 5, wherein the first wall is defined by a nozzle ring.

18. The variable geometry turbine according to claim 5, wherein the openings in the second wall are in the form of slots.

19. The variable geometry turbine according to claim 18, wherein each slot is designed to receive a respective vane in a snug fit so as to seal against the passage of gas between them.

20. The variable geometry turbine according to claim 5, wherein a generally annular rib is provided on said face of the first or second wall such that the minimum width of the inlet passageway is defined between the rib and a portion of the facing wall.

21. The variable geometry turbine according to claim 20, wherein the rib is perforated or discontinuous so that it provides at least one gas passage when it is in contact with the other wall to allow gas to flow to the annular inlet passageway.

22. The variable geometry turbine according to claim 21, wherein the rib circumscribes said inlet vanes.

23. The variable geometry turbine according to claim 5, wherein the predetermined position of the walls is a substantially closed position

24. The variable geometry turbine according to claim 5, wherein the turbine is disposed within a turbocharger that includes a compressor driven by said turbine.

* * * * *